United States Patent [19]

Kushibe

[11] 3,948,703

[45] Apr. 6, 1976

[54] METHOD OF CHEMICALLY POLISHING COPPER AND COPPER ALLOY

[75] Inventor: Kazuyoshi Kushibe, Shizuoka, Japan

[73] Assignee: Tokai Denka Kogyo Kabushiki Kaisha, Tokyo, Japan

[22] Filed: Nov. 26, 1973

[21] Appl. No.: 419,030

[30] Foreign Application Priority Data

Mar. 27, 1973 Japan ..... 48-34067

[52] U.S. Cl. ..... 156/20; 252/79.4

[51] Int. Cl.[2] ..... C09K 13/06

[58] Field of Search ..... 156/18, 14, 20; 252/79.4, 252/79.2, 413, 438, 439; 134/2, 41

[56] References Cited

UNITED STATES PATENTS

| | | | |
|---|---|---|---|
| 2,849,297 | 8/1958 | Wisken | 252/79.4 |
| 3,293,093 | 12/1966 | Jones et al. | 156/20 |
| 3,412,032 | 11/1968 | Jenks | 156/18 |
| 3,770,530 | 11/1973 | Fujimoto et al. | 252/79.4 |
| 3,773,577 | 11/1973 | Shibasaki et al. | 156/18 |
| 3,809,588 | 5/1974 | Zeblisky | 156/18 |

*Primary Examiner*—Douglas J. Drummond
*Assistant Examiner*—Jerome W. Massie
*Attorney, Agent, or Firm*—Flynn & Frishauf

[57] ABSTRACT

This invention provides a method of chemically polishing copper and copper alloys which comprises using a solution with one or more members selected from azoles having the structure represented by the general formulae

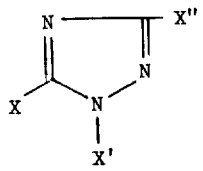

(I)

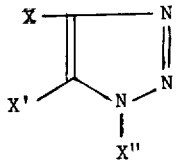

(II)

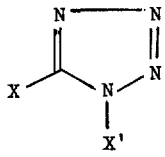

(III)

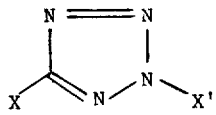

(IV)

wherein X, X′ and X″ represent any of hydrogen, amino, aminoalkyl containing 1–3 carbon atoms and alkyl containing 1–3 carbon atoms added to an acid aqueous solution of hydrogen peroxide containing hydrogen peroxide and sulfuric or nitric acid.

9 Claims, No Drawings

METHOD OF CHEMICALLY POLISHING COPPER AND COPPER ALLOY

BACKGROUND OF THE INVENTION

1. Field of the Invention

This invention relates to a method of chemically polishing copper and copper alloys. More particularly, it is concerned with a method of chemically polishing copper and copper alloys using a solution with organic compound(s) selected from azoles added to an aqueous solution containing hydrogen peroxide and sulfuric or nitric acid. An object of the invention is to provide a uniform brilliant surface by a safe and easy treatment.

2. Description of the Prior Art

Chemical polishing of copper and copper alloy materials is widely used in industrial fields for the production of decorations, electric parts, camera parts, lighter parts and the like. As the method of chemically polishing the surface of copper and copper alloy materials have heretofore been employed nitric, sulfuric and hydrochloric acid-containing mixed aqueous solutions. They are, however, disadvantageous in that production of materials with a definite quality is considerably delicate, toxic nitrous gas is evolved during the operation, etc.

As an improvement of these disadvantages there is known a method comprising the treatment with an aqueous solution containing hydrogen peroxide and sulfuric or nitric acid to form an oxidized coating upon the metal surface and subsequent removal of the oxidized coating by solubilization to afford a brilliant surface. This method involves formation of a coating of oxide upon the metal surface, which is secondarily dissolved in the polishing solution whereby repeated formation and dissolving of an oxidized coating results in smoothness of the surface. However, repetition of the formation of an oxidized coating and the dissolving of the oxidized coating into the polishing solution will be possible if the molar ratio of hydrogen peroxide to the acid is specified within a very small range. Beyond the range, there is obtained no polishing effect at all. It is therefore necessary to constantly maintain the hydrogen peroxide to acid molar ratio within a small range and furthermore there is needed procedures for removing the oxidized coating formed in the chemical polishing by dissolving in a separate bath with a result that more treatment steps are disadvantageously involved.

SUMMARY OF THE INVENTION

As a result of extensive investigations into improvement of the above-mentioned disadvantages I have come to the invention which comprises adding for the treatment one or more organic compounds selected from azoles in an acid aqueous solution of hydrogen peroxide.

DESCRIPTION OF THE INVENTION

This invention provides a method for chemically polishing copper and copper alloys using a solution prepared by adding azoles in an aqueous solution containing hydrogen peroxide and sulfuric or nitric acid. According to this invention there can be obtained the brilliant surface with no need of forming oxidized coating on the surface. Thus, unlike the known methods involving formation of oxidized coating the hydrogen peroxide to acid molar ratio employed is no longer specified to a small range as well as no procedures are required for removing the oxidized coating by dissolving in a separate bath. It is therefore a chemically polishing process being excellent in practical use which the advantages of very much simplified procedure and control.

The azoles used in the invention are compounds represented by the general formulae

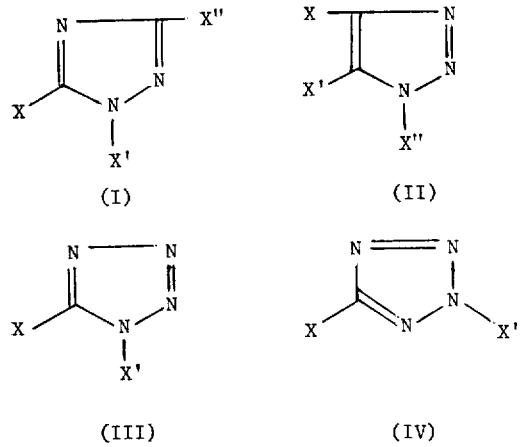

wherein X, X′ and X″ represent any of hydrogen, amino, aminoalkyl containing 1–3 carbon atoms and alkyl containing 1–3 carbon atoms. As the azoles represented by the general formulae are mentioned, for example, 1,2,4-triazole, 3-methyl-1,2,4-triazole, 3,5-dimethyl-1,2,4-triazole, 1-amino-1,2,4-triazole, 3-amino-1,2,4-triazole, 5-amino-3-methyl-1,2,4-triazole, 3-isopropyl-1,2,4-triazole and the like.

As the azoles represented by the general formula (II) are mentioned, for example, 1,2,3-triazole, 1-methyl-1,2,3-triazole, 1-amino-1,2,3-triazole, 1-amino-5-methyl-1,2,3-triazole, 4,5-dimethyl-1,2,3-triazole, 1-amino-5-n-propyl-1,2,3-triazole, 1-(β-amino-ethyl)-1,2,3-triazole and the like.

As the azoles represented by the formulae (III) and (IV) are mentioned, for example, tetrazole, 1-methyltetrazole, 2-methyltetrazole, 5-amino-1H-tetrazole, 5-amino-1-methyltetrazole, 1-(β-aminoethyl)tetrazole and the like.

According to the present invention a very good polishing is feasible by the treatment with an aqueous solution containing hydrogen peroxide and sulfuric or nitric acid with one or more of the above-mentioned azoles having the structure represented by the general formulae above added.

The polishing solution used in polishing copper and copper alloy according to the polishing method of the invention contains 50–200 g./l. of hydrogen peroxide, 10–150 g./l. of sulfuric or nitric acid and 0.01–10 g./l. of one or more azoles having the structure represented by the above-mentioned general formulae.

In practice, the polishing solution contains stabilizer such as glycol ethers and alcohols for inhibiting decomposition of hydrogen peroxide, and a surface active agent for facilitating contact between the metal and the solution by reducing surface tension of the solution, which do not influence upon the result of the invention.

Suitable treating temperature is 20°–50°C and lower temperatures will not result in the expected effects, whereas higher temperatures will not be convenient because of acceleration of the decomposition of hydrogen peroxide, increase in rates of oxidation, decomposition and vaporization of the azoles thereby lowering durability of the polishing effect.

Good brilliant surface with uniform finish can be obtained by carrying out the chemical polishing of copper and copper alloy according to the above-described method.

DESCRIPTION OF THE PREFERRED EMBODIMENT

Examples of the invention will be given below but the invention is not intended to be limited to these examples.

EXAMPLE 1

A brass plate (Cu60 Zn40) was treated by dipping in a solution containing 100 g./l. of $H_2O_2$, 50 g./l. of $H_2SO_4$, 0.5 g./l. of 5-amino-1H-tetrazole, 10 ml./l. of ethyleneglycol monoethylether and 1 g./l. of a nonionic surface active agent at 30°C for 1 minute. There was obtained brilliant surface.

EXAMPLE 2

A pure copper plate was treated by dipping in a solution containing 75 g./l. of $H_2O_2$, 30 g./l. of $HNO_3$, 2 g./l. of 3-amino-1,2,4-triazole, 50 ml./l. of ethyl alcohol and 0.5 g./l. of a nonionic surface active agent at 40°C for 30 seconds. There was obtained brilliant uniform surface.

EXAMPLE 3

A beryllium copper plate was treated by dipping in a solution containing 50 g./l. of $H_2O_2$, 40 g./l. of $H_{41\ 2}SO_4$, 20 g./l. of $HNO_3$, 5 g./l. of 1-amino-1,2,3-triazole, 50 ml./l. of methyl alcohol and 2 ml./l. of a nonionic surface active agent at 25°C for about 2 minutes. There was obtained brilliant surface.

EXAMPLE 4

A pure copper plate was treated by dipping in a solution composed of 150 g./l. of $H_2O_2$, 100 g./l. of $H_2SO_4$, 0.1 g./l. of 1,2,4-triazole, 0.1 g./l. of 1,2,3-triazole, 0.1 g./l. of tetrazole, 20 ml./l. of ethyleneglycol monomethylether and 1 g./l. of a nonionic surface active agent at 45°C for 10 seconds. There was obtained brilliant surface.

I claim:

1. Method of chemically polishing copper or a copper alloy which comprises contacting copper or a copper alloy with an aqueous solution containing one or more members selected from azoles having the structure represented by the general formulae

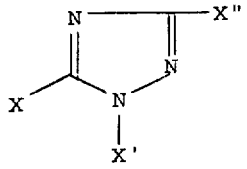

(I)

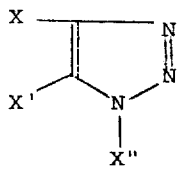

(II)

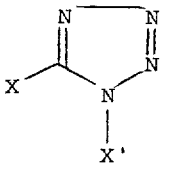

, or (III)

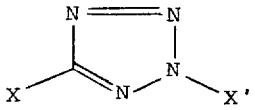

(IV)

wherein X, X′ and X″ represent any of hydrogen, amino, aminoalkyl containing 1–3 carbon atoms and alkyl containig 1–3 carbon atoms, hydrogen peroxide, and sulfuric or nitric acid.

2. Method according to claim 1 wherein the azoles are of the general formula (I) and are selected from the group consisting of 1,2,4-triazole, 3-methyl-1,2,4-triazole, 3,5-dimethyl-1,2,4-triazole, 1-amino-1,2,4-triazole, 3-amino-1,2,4-triazole, 5-amino-3-methyl-1,2,4-triazole, and 3-isopropyl-1,2,4-triazole.

3. Method according to claim 1 wherein the azoles are of the general formula (II) and are selected from the group consisting of 1,2,3-triazole, 1-methyl-1,2,3-triazole, 1-amino-1,2,3-triazole, 1-amino-5-methyl-1,2,3-triazole, 4,5-dimethyl-1,2,3-triazole, 1-amino-5(n)propyl-1,2,3-triazole, and 1-(β-amino-ethyl)-1,2,3-triazole.

4. Method according to claim 1 wherein the azoles are of the general formula (III) or (IV) and are selected from the group consisting of tetrazole, 1-methyltetrazole, 2-methyl-tetrazole, 5-amino-1H-tetrazole, 5-amino-1-methyltetrazole, and 1-(β-amino-ethyl)-tetrazole.

5. Method according to claim 1 wherein said solution contains 50 to 200 g./l. of hydrogen peroxide, 10 to 150 g./l. of sulfuric or nitric acid, and 0.01 to 10 g./l. of one or more of said azoles.

6. Method according to claim 1 wherein said solution contains a stabilizer and a surface active agent.

7. Method according to claim 1 wherein the copper or copper alloy is so contacted at a temperature ranging from 20° to 50°C.

8. Method according to claim 1 wherein said solution contains a glycol ether stabilizer and a surface active agent.

9. Method according to claim 1 wherein said solution contains an alcohol stabilizer and a surface active agent.

* * * * *